US009917350B2

(12) United States Patent
Noh et al.

(10) Patent No.: US 9,917,350 B2
(45) Date of Patent: Mar. 13, 2018

(54) MULTI LOOP ANTENNA MODULE AND PORTABLE DEVICE HAVING THE SAME

(71) Applicant: AMOTECH CO., LTD., Incheon (KR)

(72) Inventors: Jin-Won Noh, Gwangju (KR); Hyung-Il Baek, Gyeonggi-do (KR); Beom-Jin Kim, Gyeonggi-do (KR); Chi-Ho Lee, Incheon (KR)

(73) Assignee: Amotech Co., Ltd., Incheon (KR)

( * ) Notice: Subject to any disclaimer, the term of this patent is extended or adjusted under 35 U.S.C. 154(b) by 0 days.

(21) Appl. No.: 14/896,956

(22) PCT Filed: Sep. 11, 2015

(86) PCT No.: PCT/KR2015/009585

§ 371 (c)(1),
(2) Date: Dec. 9, 2015

(87) PCT Pub. No.: WO2016/039584

PCT Pub. Date: Mar. 17, 2016

(65) Prior Publication Data

US 2017/0179574 A1 Jun. 22, 2017

(30) Foreign Application Priority Data

Sep. 12, 2014 (KR) ..... 10-2014-0120996

(51) Int. Cl.

| | |
|---|---|
| ***H01Q 7/00*** | (2006.01) |
| ***H01Q 1/24*** | (2006.01) |
| ***H01Q 7/06*** | (2006.01) |

(52) U.S. Cl.
CPC ..... *H01Q 1/243* (2013.01); *H01Q 7/00* (2013.01); *H01Q 7/06* (2013.01)

(58) Field of Classification Search
None
See application file for complete search history.

(56) References Cited

U.S. PATENT DOCUMENTS

2010/0052996 A1* 3/2010 Ochi ..... G06K 19/07732 343/702
2010/0309081 A1* 12/2010 Kobayashi ..... G06K 7/10316 343/788
2012/0306714 A1* 12/2012 Yosui ..... H01Q 1/2208 343/788
2014/0035790 A1* 2/2014 Chatani ..... H01Q 1/38 343/788

(Continued)

FOREIGN PATENT DOCUMENTS

KR 10-2007-0093852 A 9/2009
KR 10-2009-0126323 A 12/2009

(Continued)

*Primary Examiner* — Trinh Dinh
(74) *Attorney, Agent, or Firm* — Baker & Hostetler LLP

(57) ABSTRACT

The present invention provides a multi loop antenna module that maximizes antenna performance even in a portable terminal equipped with a metallic rear cover, using an antenna pattern formed in a multi loop shape, and a portable terminal having the multi loop antenna module. The multi loop antenna module may include: an antenna sheet having a radiation pattern with two or more loops on a side; and a magnetic sheet mounted on a rear side of the antenna sheet.

7 Claims, 11 Drawing Sheets

(56) References Cited

U.S. PATENT DOCUMENTS

| | | | | |
|---|---|---|---|---|
| 2014/0176382 | A1* | 6/2014 | Nakano | H01Q 1/243 343/788 |
| 2014/0176384 | A1* | 6/2014 | Yosui | H01Q 7/06 343/788 |
| 2014/0218262 | A1* | 8/2014 | Tsubaki | H01Q 7/00 343/867 |
| 2015/0048985 | A1* | 2/2015 | Park, II | H01Q 7/06 343/788 |
| 2015/0180126 | A1* | 6/2015 | Nakano | G06K 7/10009 343/788 |
| 2015/0188227 | A1* | 7/2015 | Schaefer | H01Q 7/06 343/720 |
| 2015/0214619 | A1* | 7/2015 | Shimizu | H01Q 1/243 343/748 |
| 2015/0333389 | A1* | 11/2015 | Orihara | H01Q 1/2225 343/788 |
| 2016/0079658 | A1* | 3/2016 | Jung | H01Q 1/243 343/702 |

FOREIGN PATENT DOCUMENTS

| | | | |
|---|---|---|---|
| KR | 10-1098263 | B1 | 12/2011 |
| KR | 10-2012-0098985 | A | 9/2012 |
| KR | 10-2013-0062751 | A | 6/2013 |
| KR | 10-2013-0134759 | A | 12/2013 |
| KR | 10-2014-0102617 | A | 8/2014 |
| KR | 10-2014-0102619 | A | 8/2014 |

* cited by examiner

| ANTENNA MODULE (69mmx 20mm) | MATERIAL OF REAR COVER | DISTANCE(mm) | | | | | Vpp(mV) | | | |
|---|---|---|---|---|---|---|---|---|---|---|
| | | CARD MODE (mm) | READER MODE(mm) | | | | EMVCo(mV) | | | |
| | | | | | | | TYPE A | | | |
| | | VIVO PAY 5000m | TOPAZ | ULTRA LIGHT | FELICA | DESFIRE EV1 | 0,0,0 (MIN.8.8) | 1,0,0 (MIN.7.2) | 2,0,0 (MIN.5.6) | 3,0,0 (MIN.4.0) |
| SINGLE LOOP OF RELATED ART | NON-METAL | 65 | 40 | 38 | 32 | 21 | 42.6 | 28.6 | 16.2 | 8.8 |
| | METAL | 18 | 11 | 11 | 7 | 5 | 7.3 | 5.4 | 3.8 | 2.6 |
| DOUBLE LOOP OF INVENTION (FIG. 3) | NON-METAL | 53 | 32 | 31 | 30 | 19 | 36.1 | 26.5 | 14.1 | 6 |
| | METAL | 57 | 33 | 33 | 32 | 22 | 48.6 | 26.8 | 14.7 | 6.4 |
| DOUBLE LOOP OF INVENTION (FIG. 4) | NON-METAL | 31 | 20 | 21 | 14 | 10 | 18.6 | 12.5 | 8.4 | 3.1 |
| | METAL | 57 | 39 | 40 | 33 | 19 | 20.1 | 15.4 | 10.6 | 6.8 |
| DOUBLE LOOP OF INVENTION (FIG. 5) | NON-METAL | 52 | 38 | 38 | 32 | 19 | 42.1 | 28.1 | 15.3 | 6.4 |
| | METAL | 38 | 32 | 31 | 27 | 16 | 22.8 | 16.2 | 9.4 | 5.1 |
| DOUBLE LOOP OF INVENTION (FIG. 6) | NON-METAL | 42 | 28 | 28 | 24 | 16 | 35.3 | 26.4 | 12.5 | 4.9 |
| | METAL | 52 | 31 | 30 | 28 | 17 | 44.1 | 25.3 | 12.6 | 5.1 |
| DOUBLE LOOP OF INVENTION (FIG. 7) | NON-METAL | 58 | 32 | 32 | 30 | 18 | 20.5 | 12.9 | 9.8 | 6.3 |
| | METAL | 58 | 32 | 31 | 30 | 18 | 19.6 | 13.1 | 9.6 | 6.2 |

FIG. 8

MULTI LOOP ANTENNA MODULE AND PORTABLE DEVICE HAVING THE SAME

TECHNICAL FIELD

The present invention relates to a multi loop antenna module and a portable terminal having the same and, more particularly, to a multi loop antenna module installed in a portable terminal and communicating with an antenna module another electronic device, and a portable terminal having the multi loop antenna module.

The present application is a National Stage of International patent application PCT/KR2015/009585, filed on Sep. 11, 2015, which claims the benefit of Korean Patent Application No. KR 10-2014-0120996, filed on Sep. 12, 2014, the contents of which are entirely incorporated herein by reference.

BACKGROUND ART

With technological advances, portable terminals such as a mobile phone, a PDA, and PMP, a navigation system, and a laptop are equipped to additionally provide a local communication functions between devices such as DMB, wireless internet, in addition to basic functions such as calling, playing video/music, and navigation. Accordingly, portable terminals are equipped with a plurality of antennas for wireless communication such as wireless internet and Bluetooth.

Further, recently, functions such as information exchange between terminals, settlement, ticket advance purchase, and searching using local communication (that is, NFC) are applied to portable terminals. To this end, portable terminals are equipped with an antenna module (that is, NFC antenna module) used in for local communication. The NFC antenna module is a non-contact local wireless communication module, which is an RFID using a frequency band of about 13.56 Hz, and transmits data between terminals at a short distance about 10 cm. NFC is used in various areas such as transmission of product information at a supermarket or a store or transmission of travel information of visitors, traffic, access control, and a locking system, in addition to payment.

In general, NFC antenna modules are formed flat and mounted on a battery pack and a battery cover, etc. That is, NFC antenna modules are designed to communicate with NFC antenna modules in other electronic devices by forming a radiation field toward the rear side of portable terminals for convenience for users and structural features.

However, recently, the rear covers of portable terminals are increasingly made of metal, so the performance of built-in antennas such as the NFC antenna is deteriorated.

To solve this problem in the related art, the portions around a camera and a flash in those metallic rear covers have been made of non-metallic materials and then an antenna has been mounted.

However, since the non-metallic area for mounting an antenna is small and surrounded by metal, there is still a problem that the performance of the antenna is deteriorated.

DISCLOSURE

Technical Problem

Accordingly, the present invention has been made keeping in mind the above problems occurring in the related art, and the present invention is intended to propose a multi loop antenna module that maximizes the performance of an antenna even in a portable terminal having a metallic rear cover by forming an antenna pattern in a multi loop type, and a portable terminal having the multi loop antenna.

Technical Solution

In order to accomplish the above object, the present invention provides a multi loop antenna module that includes: an antenna sheet having a radiation pattern with two or more loops on a side; and a magnetic sheet mounted on a rear side of the antenna sheet.

The antenna sheet may overlap a non-metallic area around holes formed through a rear cover of a portable terminal.

Holes formed through the rear cover may be disposed inside at least one of the two or more loops on the antenna sheet.

The antenna sheet may include: a circuit board having a first non-patterned portion and a second non-patterned portion; and a radiation pattern forming at least two or more loops by being wound around outsides of the first non-patterned portion and the second non-patterned portion.

The radiation pattern may form a first loop by being wound several times around an outside of the first non-patterned portion and form a second loop by being wound several times around an outside of the second non-patterned portion.

The radiation pattern may form a third loop by being wound several times around outsides of the first loop and the second loop.

The radiation pattern may be wound in opposite directions around the outsides of the first non-patterned portion and the second non-patterned portion.

The radiation pattern may form the first loop and the second loop by being alternatively wound around the outsides of the first non-patterned portion and the second non-patterned portion.

The magnetic sheet may be at least one of a ferrite sheet, an amorphous sheet, and a magnetic polymer sheet.

Further, the present invention provides a portable terminal that includes: a body; a rear cover mounted on a rear side of the body; and a multi loop antenna module overlapping a non-metallic area around holes formed through the rear cover.

The multi loop antenna module may include: an antenna sheet having a radiation pattern with two or more loops on a side; and a magnetic sheet mounted on a rear side of the antenna sheet.

The antenna sheet may include: a circuit board having a first non-patterned portion and a second non-patterned portion; and a radiation pattern forming at least two or more loops by being wound around outsides of the first non-patterned portion and the second non-patterned portion.

Advantageous Effects

According to the present invention, when the multi loop antenna module having an antenna pattern in a multi loop shape is mounted on a metallic rear cover, it generates a radiation field larger than that of the antenna pattern formed in a single loop shape having the same area. Therefore, when the multi loop antenna module is mounted on a metallic rear cover, the antenna performance can be significantly improved.

DESCRIPTION OF DRAWINGS

FIGS. 8 to 12 are diagrams comparing characteristics of a single loop antenna of the related art and a multi loop antenna module according to an embodiment of the present invention.

MODE FOR INVENTION

Figure 1:
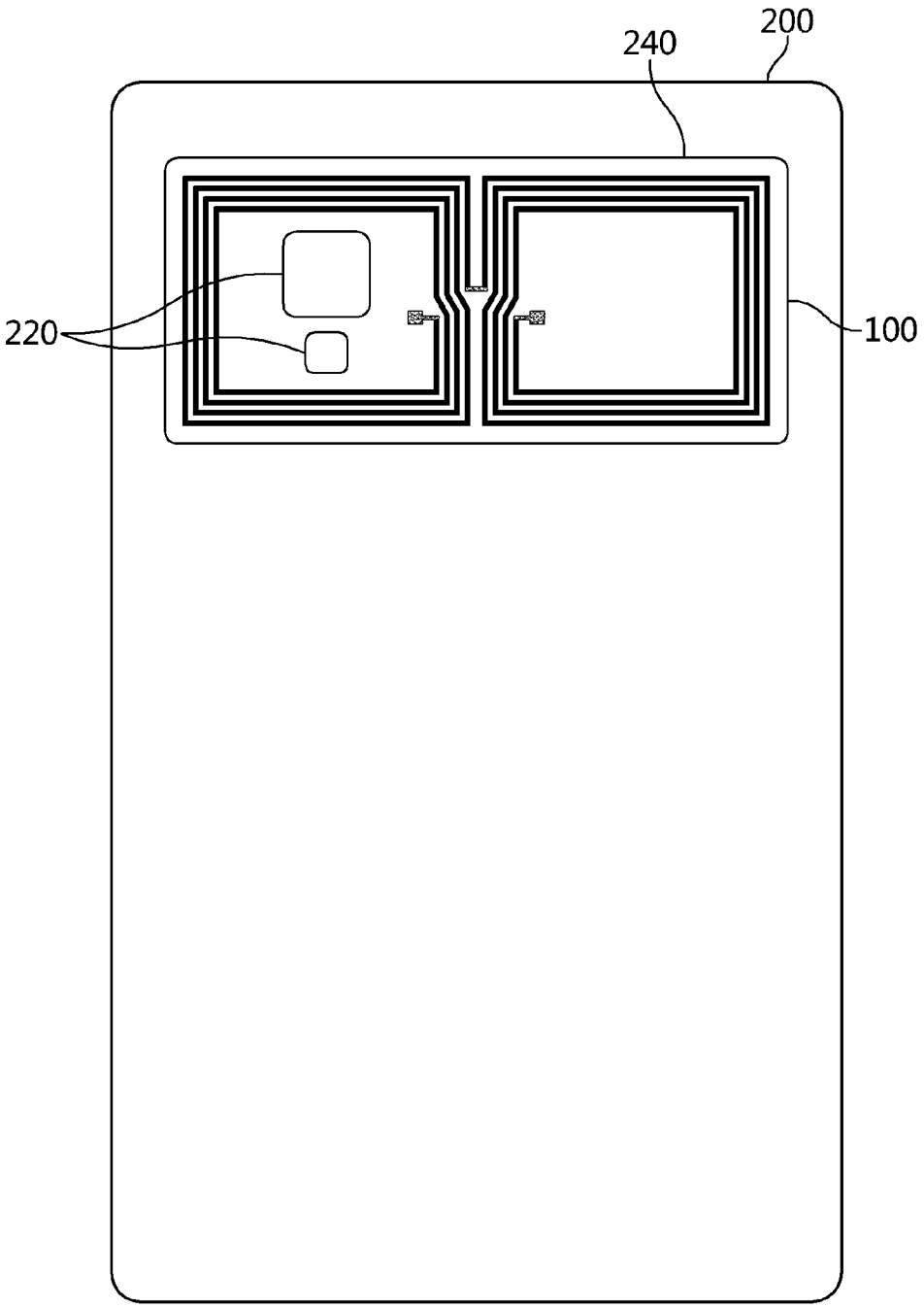
FIGS. 1 and 2 are diagrams illustrating a multi loop antenna module according to an embodiment of the present invention.

Exemplary embodiments of the present invention will be described below with reference to the accompanying drawings in order for those skilled in the art to be able to easily implement the technical spirit of the present invention. First, in the specification, in adding reference numerals to components throughout the drawings, it should be noted that like reference numerals designate like components even though components are shown in different drawings. In describing the present invention, well-known functions or constructions will not be described in detail since they may unnecessarily obscure the understanding of the present invention.

Figure 2:
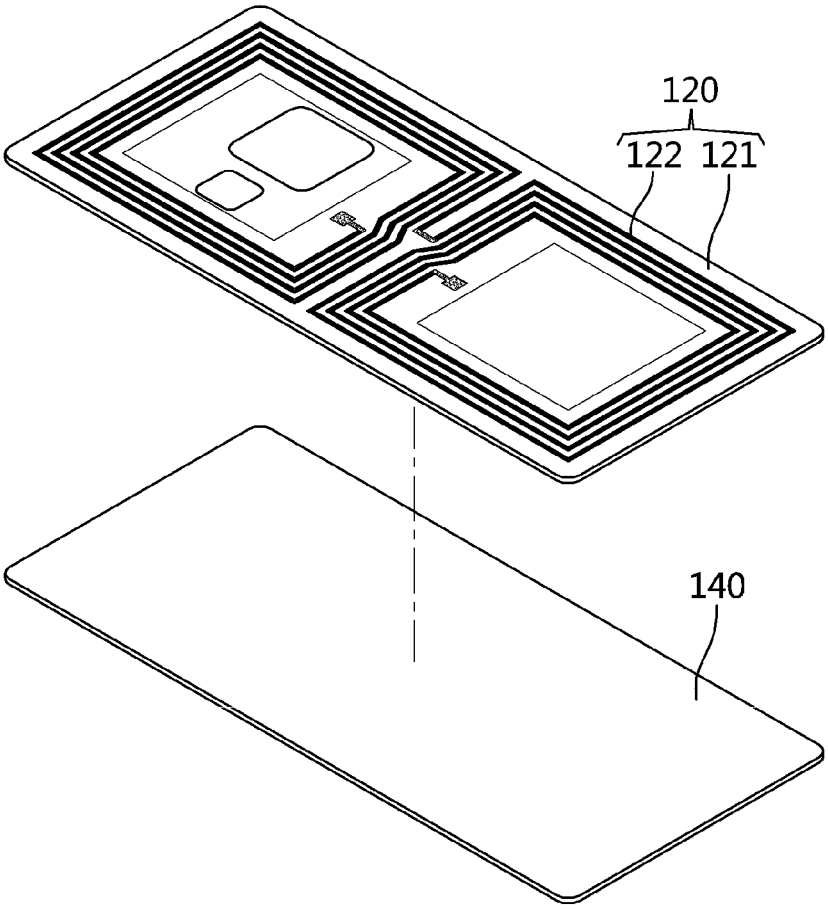

Hereafter, a multi loop antenna module according to an embodiment of the present invention is described in detail with reference to the accompanying drawings. FIGS. 1 and 2 are diagrams illustrating a multi loop antenna module according to an embodiment of the present invention and FIGS. 3 to 7 are diagrams illustrating the antenna sheet shown in FIG. 2.

As shown in FIG. 1, a multi loop antenna module 100 is mounted on a rear cover, a body (not shown), or a battery pack (not shown) of a portable terminal. The multi loop antenna module 100 overlaps a non-metallic area 240 around holes (for example, a camera hole and a light hole) formed through the rear cover 200. The multi loop antenna module 100 is formed in a shape including a plurality of loops and the holes 220 formed through the rear cover 200 are disposed inside at least one of the loops. To this end, as shown in FIG. 2, the multi loop antenna module 100 may include an antenna sheet 120 and a magnetic sheet 140.

The antenna sheet 120 is an FPCB (Flexible Printed Circuit Board) 121 and a radiation pattern is formed in the shape of a multi loop on a side of the FPCB 121. The multi loop radiation pattern 122 includes two or more loops and at least one of the loops is spaced at a predetermined distance from the holes 220 in the rear cover 200.

Figure 3:
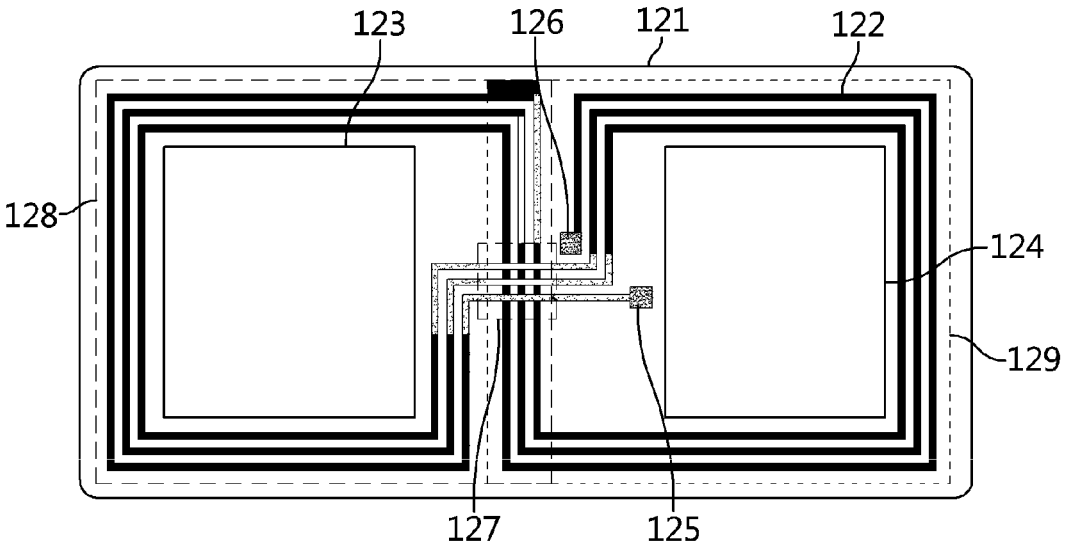
FIGS. 3 to 7 are diagrams illustrating the antenna sheet shown in FIG. 2.

Referring to FIG. 3, the antenna sheet 120 may include a first non-patterned portion 123, a second non-patterned portion 124, and a radiation pattern 122.

A first end of the radiation pattern 122 is disposed at the left side from the second non-patterned portion 124 and connected to a terminal 125 that is connected to a portable terminal. The radiation pattern 122 is wound around the outside of the first non-patterned portion 123 and then wound around the outside of the second non-patterned portion 124. The radiation pattern 122 is wound several times alternately around the outsides of the first non-patterned portion 123 and the second non-patterned portion 124 and then its second end is connected to a terminal 126, which is connected to a portable terminal, at the left side from the second non-patterned portion 124. The radiation pattern 122 has a cross area 127 between the first non-patterned portion 123 and the second non-patterned portion 124. An insulating member (not shown) is disposed in the cross area 127 and the radiation pattern 122 is formed over and under the insulating member.

Accordingly, the radiation pattern 122 forms a first loop 128 by being wound clockwise around the outside of the first non-patterned portion 123 and forms a second loop 129 by being wound counterclockwise around the outside of the second non-patterned portion 124, thereby being formed in the shape of "Go". Obviously, the radiation pattern 122 may form the first loop 128 by being wound counterclockwise around the outside of the first non-patterned portion 123 and form the second loop 129 by being wound clockwise around the outside of the second non-patterned portion 124.

Figure 4:
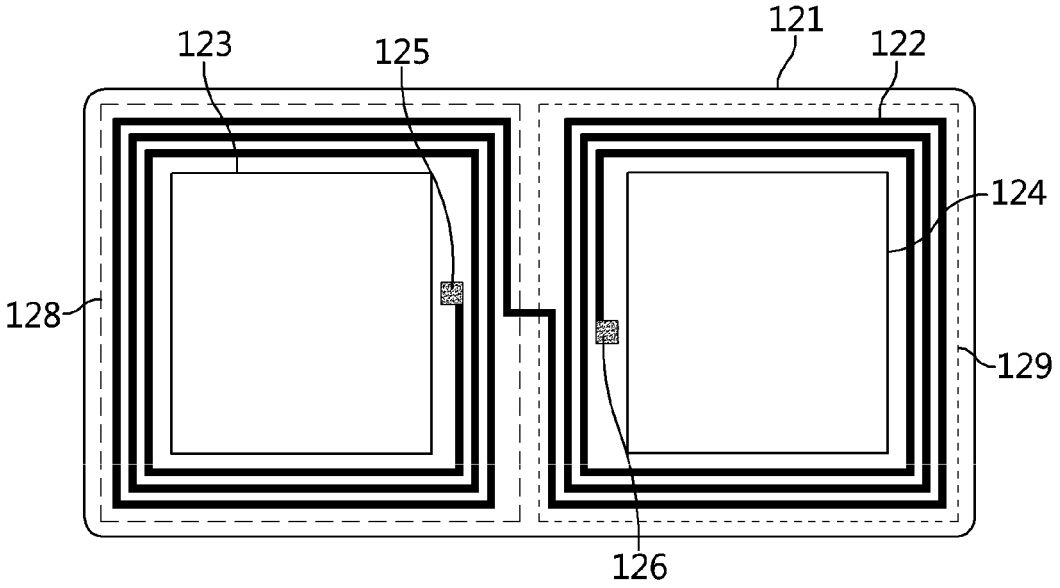

Referring to FIG. 4, the antenna sheet 120 may include a first non-patterned portion 123, a second non-patterned portion 124, and a radiation pattern 122. An end of the radiation pattern 122 is disposed at the right side from the first non-patterned portion 123 and connected to a terminal 125 that is connected to a portable terminal. The radiation pattern 122 forms a first loop 128 by being wound clockwise around the outside of the first non-patterned portion 123. The radiation pattern 122 forms a second loop 129 by being wound counterclockwise around the outside of the second non-patterned portion 124, at the left side from the second non-patterned portion 124. The radiation pattern 122 is wound away from the first non-patterned portion 123 and closer to the second non-patterned portion 124 in opposite directions. A second end of the radiation pattern 122 is connected to a terminal 126 that is connected to a portable terminal.

Accordingly, the radiation pattern 122 forms the first loop 128 by being wound clockwise around the outside of the first non-patterned portion 123 and forms the second loop 129 by being wound counterclockwise around the outside of the second non-patterned portion 124. Obviously, the radiation pattern 122 may form the first loop 128 by being wound counterclockwise around the outside of the first non-patterned portion 123 and form the second loop 129 by being wound clockwise around the outside of the second non-patterned portion 124.

Figure 5:
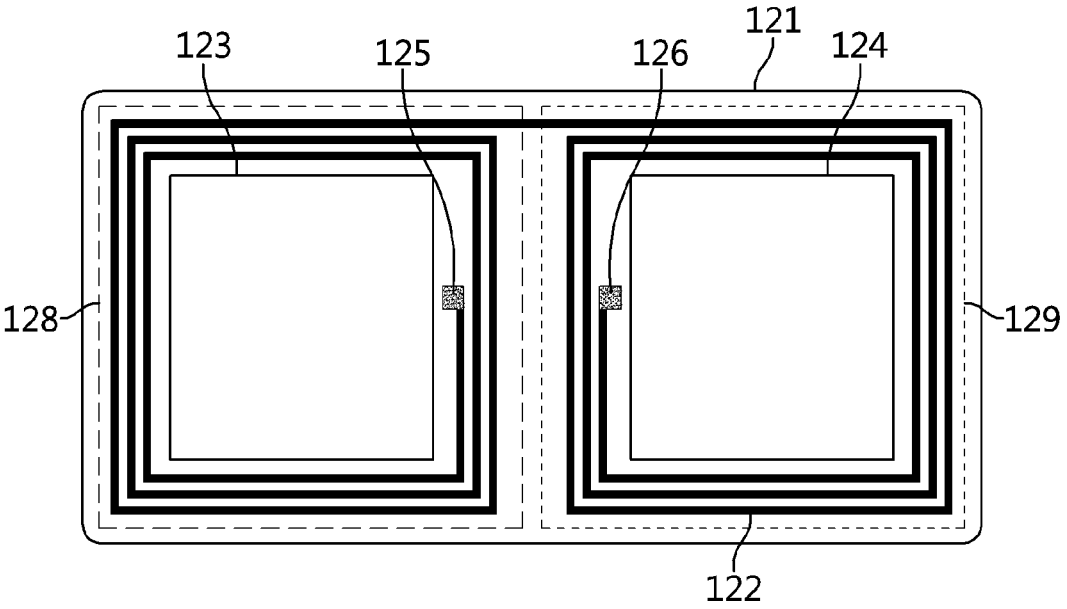

On the other hand, as shown in FIG. 5, a radiation pattern 122 may form a first loop 128 by being wound clockwise around the outside of a first non-patterned portion 123 and form a second loop 129 by being wound clockwise around the outside of a second non-patterned portion 124. Obviously, the radiation pattern 122 may form the first loop 128 by being wound counterclockwise around the outside of the first non-patterned portion 123 and form the second loop 129 by being wound counterclockwise around the outside of the second non-patterned portion 124.

Figure 6:
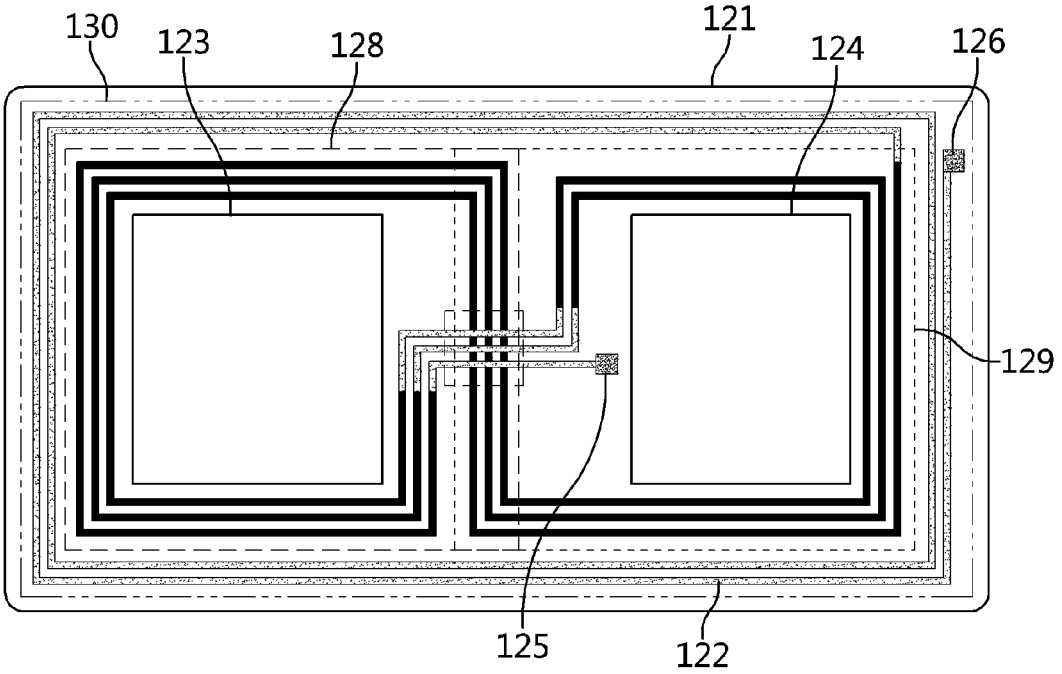

Referring to FIG. 6, the antenna sheet 120 may include a first non-patterned portion 123, a second non-patterned portion 124, and a radiation pattern 122.

An end of the radiation pattern 122 is disposed at the left side from the second non-patterned portion 124 and connected to a terminal 125 that is connected to a portable terminal. The radiation pattern 122 is wound around the outside of the first non-patterned portion 123 and then wound around the outside of the second non-patterned portion 124. The radiation pattern 122 forms a first loop 128 by being wound clockwise around the outside of the first non-patterned portion 123 and forms a second loop 129 be being wound counterclockwise around the outside of the second non-patterned portion 124. The radiation pattern 122 has a cross area 127 between the first non-patterned portion 123 and the second non-patterned portion 124. An insulating member (not shown) is disposed in the cross area 127 and the radiation pattern 122 is formed over and under the insulating member. The radiation pattern forms a third loop 130 by being wound several times clockwise (or counterclockwise) around the outside of the first loop 128 and the second loop 129.

Figure 7:
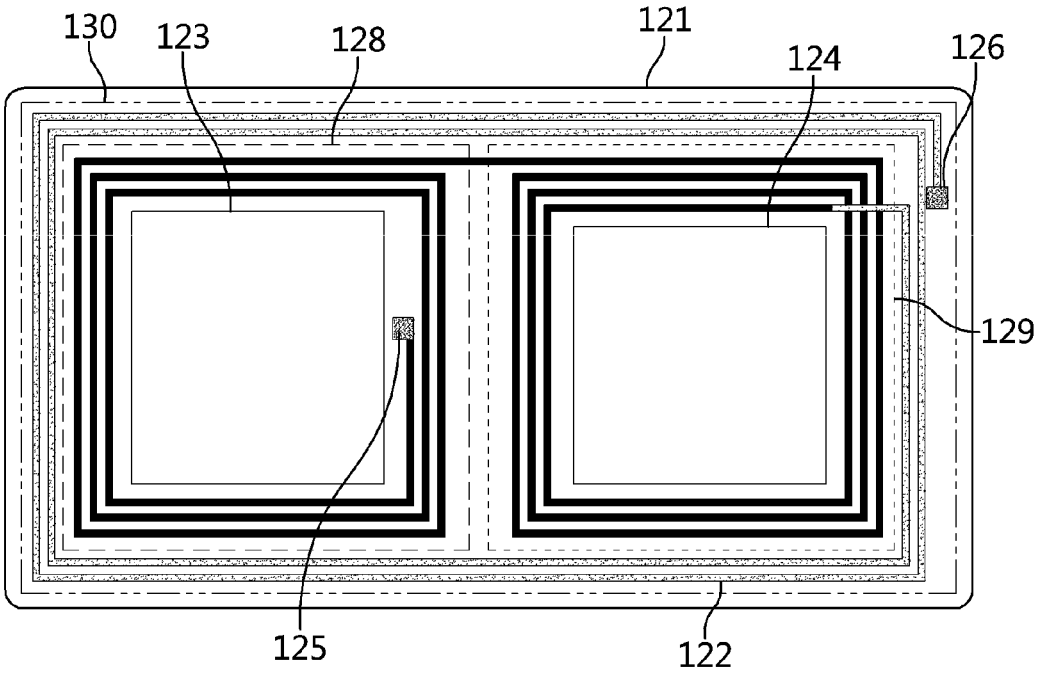
Figure 9:
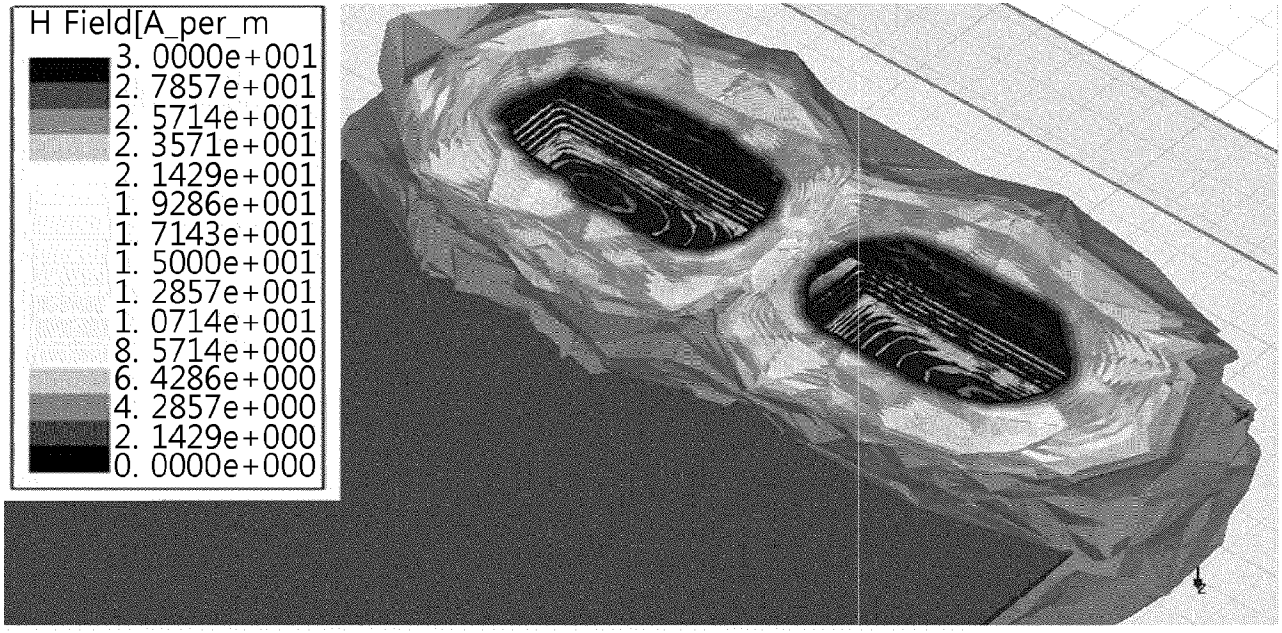
Figure 10:
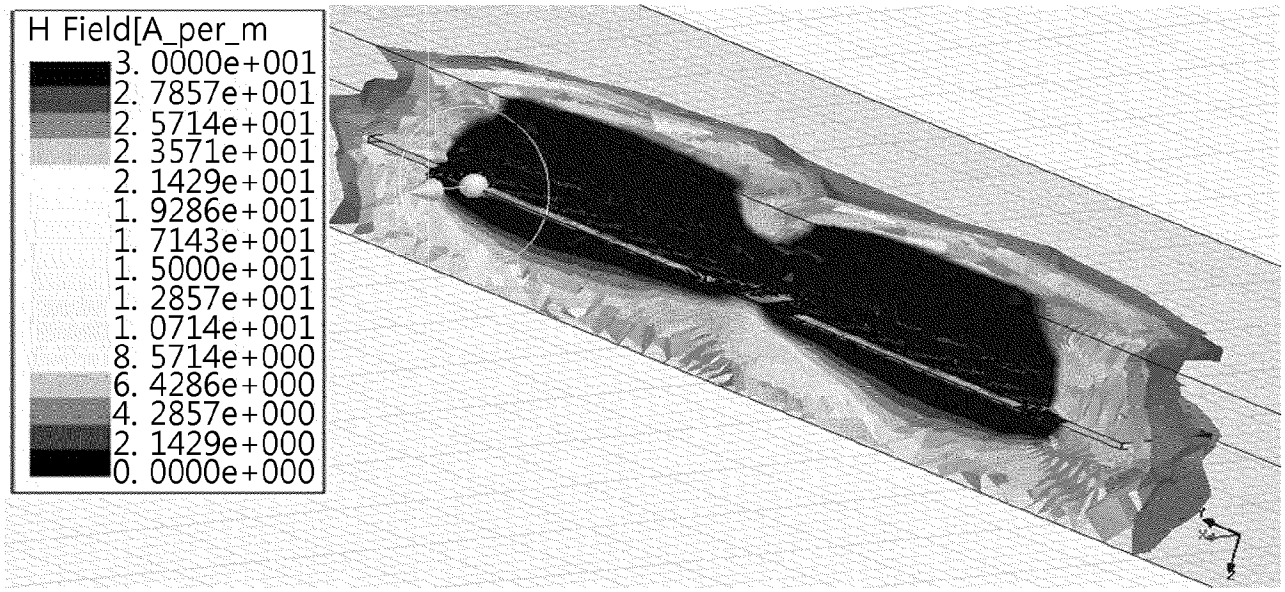
Figure 11:
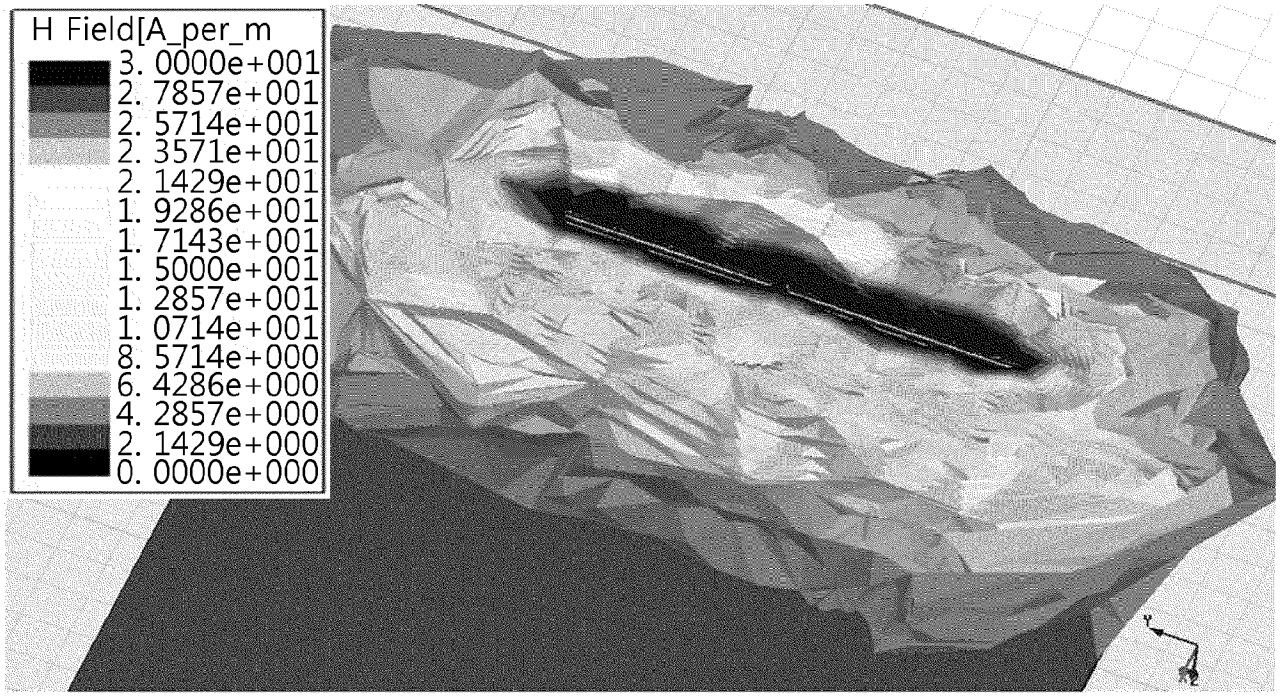
Figure 12:
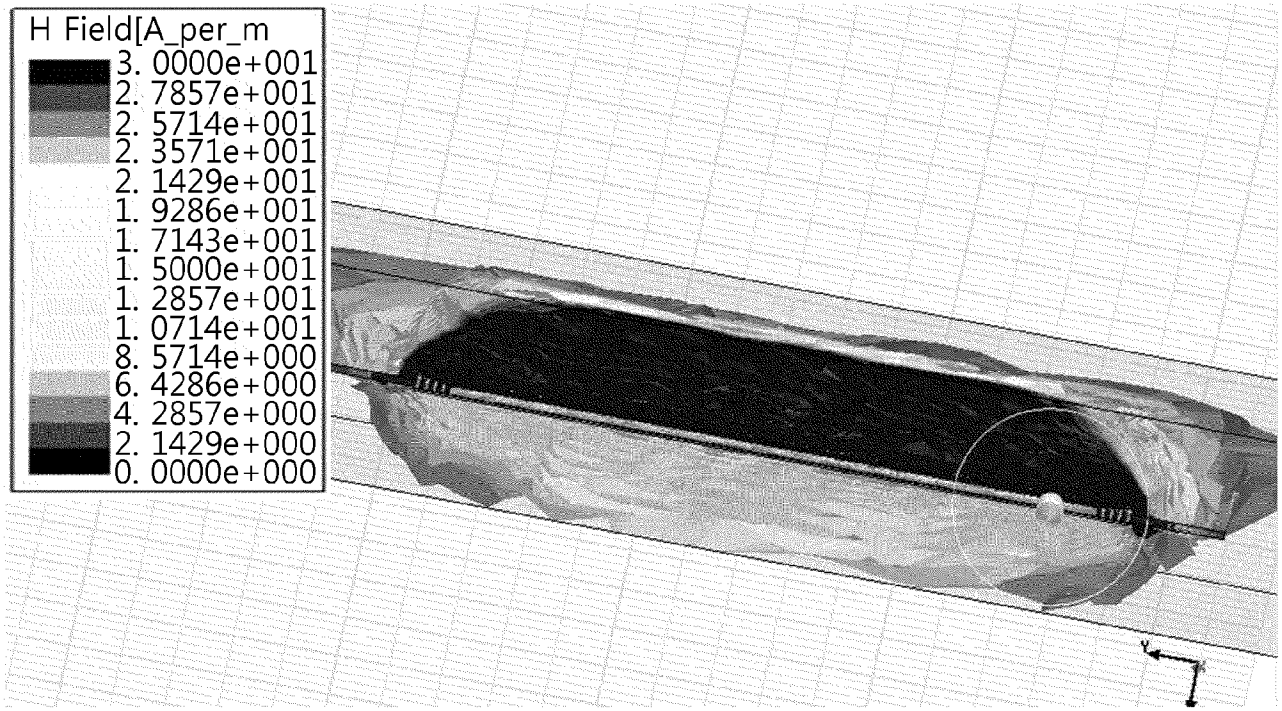

On the other hand, as shown in FIG. 7, a radiation pattern 122 may form a first loop 128 by being wound clockwise around the outside of a first non-patterned portion 123 and form a second loop 129 by being wound clockwise around the outside of a second non-patterned portion 124. Obviously, the radiation pattern 122 may form the first loop 128 by being wound counterclockwise around the outside of the first non-patterned portion 123 and form the second loop 129 by being wound counterclockwise around the outside of the second non-patterned portion 124. The radiation pattern forms a third loop 130 by being wound several times clockwise (or counterclockwise) around the outside of the first loop 128 and the second loop 129.

The magnetic sheet 140 may be a ferrite sheet, an amorphous sheet, or a magnetic polymer sheet, and the magnetic polymer sheet may be a Sendust sheet. The magnetic sheet 140 is mounted on the rear side of the antenna sheet 120. The magnetic sheet 140 is formed to overlap the non-metallic area 240 of the rear cover 200, except for the holes 220 formed through the rear cover 200, and mounted on the rear side of the antenna sheet (that is, toward the body of a portable terminal) or the body of a portable terminal.

FIGS. 8 to 12 are diagrams comparing characteristics of a single loop antenna of the related art and a multi loop antenna module 100 according to an embodiment of the present invention.

Referring to FIG. 8, a single loop antenna module of the related art decreases in antenna performance when it is mounted on a portable terminal having a metallic rear cover 200, as compared with when it is mounted on a portable terminal having a non-metallic rear cover 200. That is, the single loop antenna module of the related art considerably decreases in antenna performance when a metallic rear cover 200 is used, due to influence of metal around a non-metallic area 240. Accordingly, the single loop antenna module of the related art is available only for a non-metallic (for example, plastic) rear cover 200 and is difficult to use for a metallic cover 200 of portable terminals recently developed because the antenna performance decreases.

On the contrary, the multi loop antenna module 100 (see FIGS. 3 to 7) decreases in antenna performance when it is mounted on a portable terminal having a non-metallic rear cover in comparison to the single loop antenna module of the related art, but the antenna performance is improved when it is mounted on a portable terminal having a metallic rear cover 200 in comparison to the single loop antenna module of the related art.

FIGS. 9 to 12 show the result of analyzing radiation field distribution and intensity for antenna patterns at an NFC band (approximately 13.53 MHz) through the HFF program by AnSoft. That is, FIGS. 9 to 12 show radiation field distribution and intensity of the multi loop antennal module 100 and a single loop antenna module under the same environment. Referring to the figures, when the multi loop antennal module 100 is applied to a metallic rear cover 200, radiation fields are generated at the center portions of the loops (see FIGS. 9 and 10), so the intensity and area of the entire radiation field are increased, as compared with the radiation fields (see FIGS. 11 and 12) generated by the single loop antenna module under the same environment.

As described above, when the multi loop antenna module having an antenna pattern in a multi loop shape is mounted on a portable terminal having a metallic rear cover, it generates a radiation field larger than that of the antenna pattern formed in a single loop shape having the same area. Therefore, when the multi loop antenna module is mounted on a metallic rear cover, the antenna performance can be significantly improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A multi loop antenna module comprising:

an antenna sheet having a radiation pattern with two or more loops on a side; and a magnetic sheet mounted on a rear side of the antenna sheet, wherein the antenna sheet includes a circuit board having a first non-patterned portion and a second non-patterned portion and the radiation pattern forming at least two or more loops by being wound around outsides of the first non-patterned portion and the second non-patterned portion, wherein the radiation pattern overlaps a non-metallic area, holes being formed through a metallic rear cover of a portable terminal and the non-metallic area being formed around the holes, and wherein the radiation pattern forms a first loop by being wound several times around an outside of the first non-patterned portion overlapping the holes and forms a second loop by being wound several times around an outside of the second non-patterned portion.

2. The multi loop antenna module of claim 1, wherein holes formed through the rear cover are disposed inside at least one of the two or more loops on the antenna sheet.

3. The multi loop antenna module as set forth in claim 1 wherein the radiation pattern forms a third loop by being wound several times around outsides of the first loop and the second loop.

4. The multi loop antenna module as set forth in claim 1, wherein the radiation pattern is wound in opposite directions around the outsides of the first non-patterned portion and the second non-patterned portion.

5. The multi loop antenna module as set forth in claim 1, wherein the radiation pattern forms the first loop and the second loop by being alternatively wound around the outsides of the first non-patterned portion and the second non-patterned portion.

6. The multi loop antenna module as set forth in claim 1, wherein the magnetic sheet is at least one of a ferrite sheet, an amorphous sheet, and a magnetic polymer sheet.

7. A portable terminal comprising: a body;

a rear cover mounted on a rear side of the body; and a multi loop antenna module overlapping a non-metallic area around holes formed through the rear cover, wherein the multi loop antenna module includes an antenna sheet having a radiation pattern with two or more loops on a side and a magnetic sheet mounted on a rear side of the antenna sheet, and wherein the antenna sheet includes a circuit board having a first non-patterned portion and a second non-patterned portion and a radiation pattern forming at least two or more loops by being wound around outsides of the first non-patterned portion and the second non-patterned portion, and wherein the radiation pattern overlaps a non-metallic area, holes being formed through a metallic rear cover of a portable terminal and the non-metallic area being formed around the holes, and wherein the radiation pattern forms a first loop by being wound several times around an outside of the first non-patterned portion overlapping the holes and forms a second loop by being wound several times around an outside of the second non-patterned portion.

* * * * *